US009566701B2

(12) United States Patent
Ranjan et al.

(10) Patent No.: US 9,566,701 B2
(45) Date of Patent: Feb. 14, 2017

(54) FLAT-CLINCH STAPLER

(75) Inventors: Dakshina Ranjan, Focal Point Ludhiana (IN); Navdeep Bassi, Focal Point Ludhana (IN); Inderjit Singh, Focal Point Ludhiana (IN)

(73) Assignee: Kanin (India) (IN)

( * ) Notice: Subject to any disclaimer, the term of this patent is extended or adjusted under 35 U.S.C. 154(b) by 711 days.

(21) Appl. No.: 13/982,081

(22) PCT Filed: Jan. 27, 2011

(86) PCT No.: PCT/IB2011/000132

§ 371 (c)(1),
(2), (4) Date: Aug. 13, 2013

(87) PCT Pub. No.: WO2012/101463

PCT Pub. Date: Aug. 2, 2012

(65) Prior Publication Data

US 2014/0291376 A1 Oct. 2, 2014

(51) Int. Cl.
*B25C 5/02* (2006.01)

(52) U.S. Cl.
CPC *B25C 5/02* (2013.01); *B25C 5/025* (2013.01)

(58) Field of Classification Search
CPC ..... B25C 5/02; B25C 5/0207; B25C 5/0242; B25C 5/025; B25C 5/1603; B25C 5/1617; B27F 7/21; B27F 7/17
USPC ..... 227/129, 132
See application file for complete search history.

(56) References Cited

U.S. PATENT DOCUMENTS

2002/0005427 A1 1/2002 Aoki
2006/0138192 A1 6/2006 Matsukawa

FOREIGN PATENT DOCUMENTS

CN 101327584 A 12/2008
EP 1174224 A2 1/2002
TW 2147752 A1 * 1/2010 ..... B25C 5/0242

OTHER PUBLICATIONS

PCT International Search Report and Written Opinion in PCT/IB2011/000132, filed Jan. 27, 2011, dated Oct. 4, 2011.

* cited by examiner

*Primary Examiner* — Michelle Lopez
(74) *Attorney, Agent, or Firm* — Barnes & Thornburg LLP

(57) ABSTRACT

A flat-clinch-stapler including a base portion having upstanding bearing pieces at its rear end for supporting a first transverse pivot axis, and a floating clincher table; a magazine having a U-shaped cross section pivotably mounted at its rear end about the first pivot axis; a driver arm carrying a driver blade and being pivotably mounted at its rear end to the first pivot axis; and a handle member pivotably mounted about a second transverse axis in the bearing pieces offset relative to the first pivot axis in a direction to the front end of the base portion and acting on the driver arm at a position even further to the front end of the stapler.

2 Claims, 5 Drawing Sheets

FLAT-CLINCH STAPLER

This patent application is a U.S. nationalization under 35 U.S.C. §371 of international patent application no. PCT/IB2011/000132, filed Jan. 27, 2011, the content of which is expressly incorporated herein by reference in its entirety.

The invention relates to flat-clinch-stapler comprising a base portion having at a first rear end upstanding bearing pieces on both sides of a longitudinal horizontal plane of the stapler for supporting a first transverse pivot axis, and a floating clincher table for bending the legs of a staple at a second front end opposite to said first end. The floating clincher table is moveable between an upper paper supporting position and a lower staple bending position, and arresting means are provided for arresting the floating piece in the upper position. An elongated magazine having an U-shaped cross section comprising a bottom wall and side walls extending upwardly therefrom comprises staple guide means for receiving and guiding a plurality of staples. The magazine is pivotably mounted at its rear end about said first pivot axis and having a front end extending to a position above said clincher table. A driver arm carrying a driver blade at its front end for driving the most forward staple in said magazine into a paper stack introduced between the base portion and the magazine is pivotably mounted at its rear end to said first pivot axis. A handle member is adapted to act against the driver arm and is pivotably mounted about a second transverse axis disposed in the bearing pieces. The second axis is offset relative to said first pivot axis in a direction from the first end to the second end of the base portion, and the handle member is adapted to act on the driver arm at a position even further to the front end of the stapler, thereby resulting in a type of lever action reducing the forces required to actuate the stapler.

Staplers with such means for reducing the actuating forces are disclosed for example by the JP 55093478 A1. With such staplers, the staples are supported on guide means within the magazine with their cross members supported on a top surface of the guide means. If this type of stapler is intended for use with staples having different leg lengths, the guide means have to have a height at least corresponding to the length of the largest staples. On using staples having shorter leg lengths, there is a risk of toppling of the staples on pushing the most forward staple into the stack of paper below the magazine, resulting in a malfunction of the stapler.

US 2006/0138192 A1 discloses a flat clinch stapler of the general type set out in the preamble of claim 1 wherein a release lever for the arresting means for arresting the floating clincher table is fixed to the magazine so that at a certain fixed time buring the downward movement of the magazine by means of the handle member, the arresting means are withdrawn. Since this timing of the withdrawal of the arresting means is fixed, there is no possibility to use staplers having legs with different lengths in such a stapler.

CN 101327584 A shows a stapler wherein the release member for the arresting means of the clincher table is secured to the bottom of a leaf spring fixed to the handle member. Also with this device, an exact timing of the withdrawal of the arresting means adapted to the length of the staple lacks is not possible.

The present invention aims to avoid the problems inherent with the use of staples having different staple lengths and to provide a stapler with reliable operation and improved handling characteristics, especially for flat clinch stapling.

According to the present invention, a stapler as set out above is provided, wherein said bottom wall of said magazine forms part of the guide means for guiding a plurality of staples and is adapted to guide the free ends of the legs of the staples within the magazine. An elongated intermediate member is disposed between said magazine and said driver arm, resilient biasing mean being disposed between said driver arm and the intermediate member. The intermediate member has an inverted U-shaped cross section comprising a top wall and side walls extending downwardly therefrom, wherein the side walls of said intermediate member extend inbetween and along said side walls of said magazine, such that the bottom edges of said side walls of said intermediate member being adapted to engage the cross members of said staples within said magazine. In this manner, the staples are safely held between the bottom wall of the magazine and the lower edges of the side walls of the intermediate member, and there is no risk of toppling of the staples on pushing the most forward staple into the stack of paper below the magazine.

According to a preferred embodiment of the stapler according to the present invention, the side walls of the front end of the intermediate member are provided with respective longitudinal slots adapted to receive end portions of a roller, said roller having a length such that its free ends extend beyond the outside of the side walls of the intermediate member and into V-shaped slots in the side walls of the magazine, said V-shaped slots extending downwardly from the top edges of the side walls of the magazine. Biasing means are provided for biasing the roller against one of the side edges of the V-shaped slots such that the roller tends to ride upwardly along said edges to slightly space the lower edges of the side walls of the intermediate member from the cross members of the staples within the magazine, such that the advancement of the staples within the magazine by means of a pusher is not impeded by the intermediate member.

With flat clinch staplers, a release lever operative to release the arresting means of said floating clincher table is pivotably mounted to said driver arm about a horizontal axis extending perpendicular to a longitudinal axis of said driver arm. This release lever has downwardly extending release arms acting on said arresting means and a flat cross member connecting said release arms.

According to a preferred embodiment of the present invention, the cross member extends between a bottom surface of said driver arm and a top surface of said intermediate member, resulting in an adjustment of the timing of the release of the floating clincher table to the individual lengths of the staple legs.

A non-limiting embodiment of a stapler in accordance with the present invention will be described below with reference to the enclosed drawings.

Figure 1:
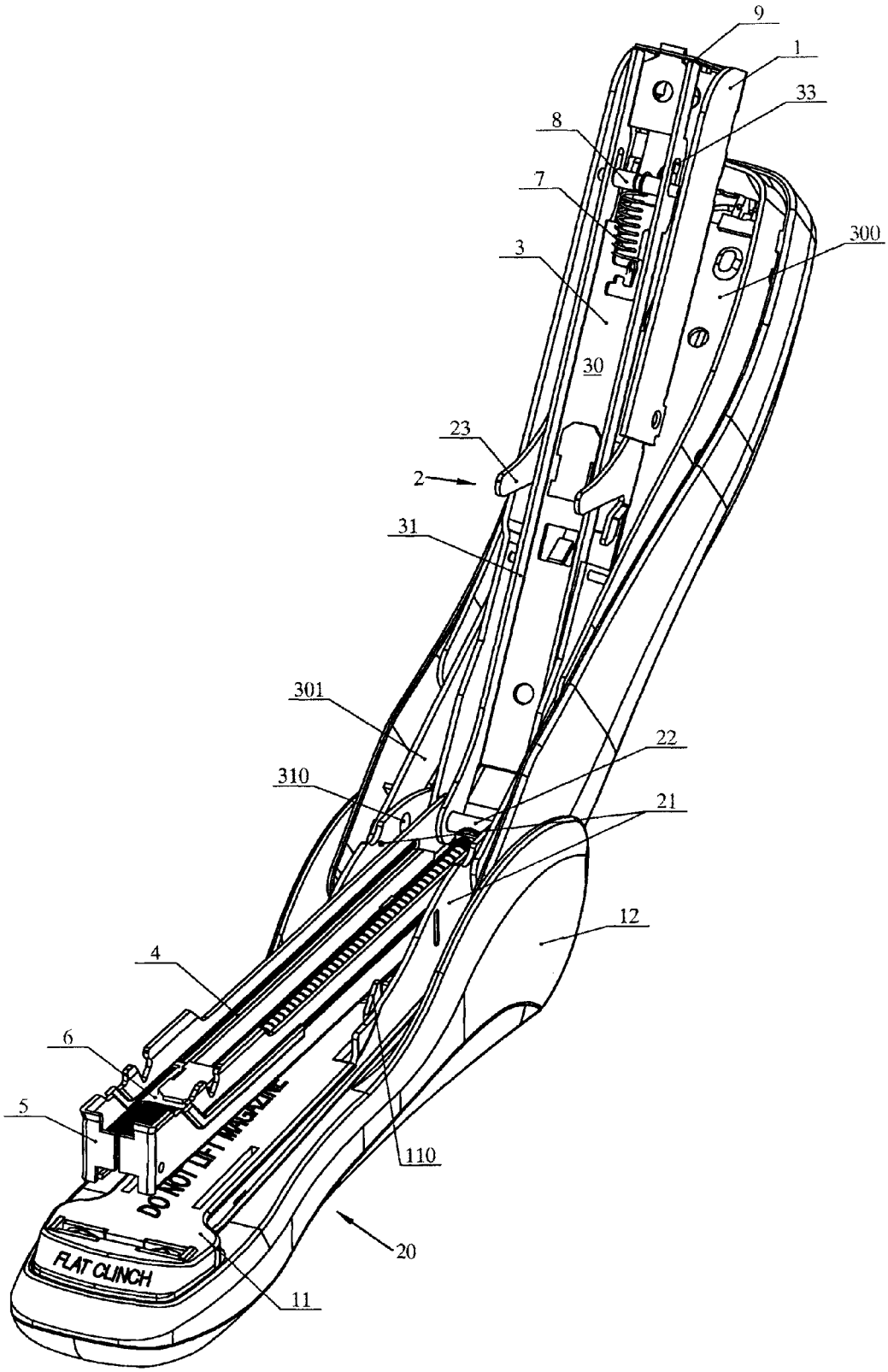
FIG. 1 shows a perspective view of an embodiment of the stapler pivoted into an open position as used for re-filling staples to show details of the construction thereof.

In FIG. 1, a perspective view of an embodiment of the stapler is shown wherein the stapler is pivoted into an open position as it is normally used for re-filling staples.

Figure 2:
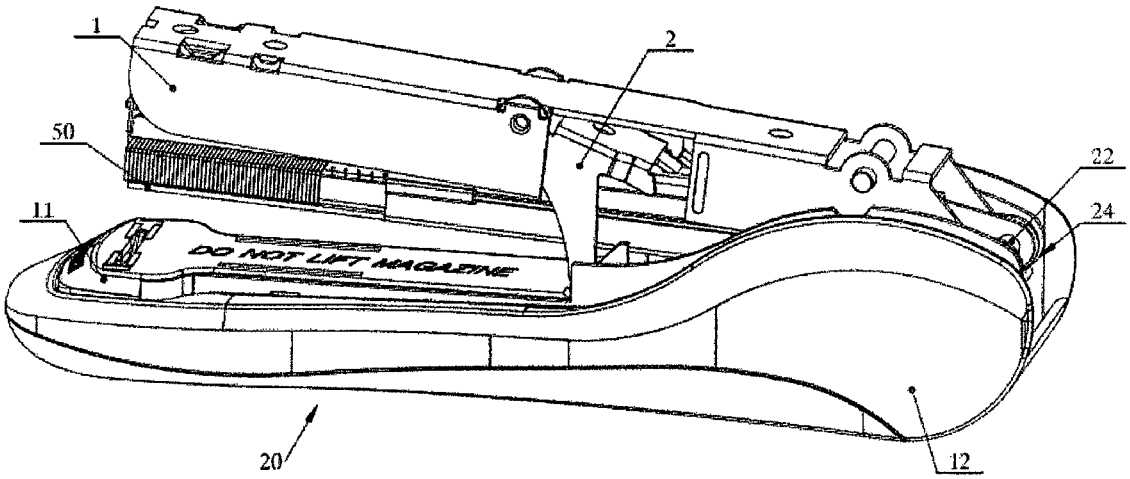
FIG. 2 shows a side view of the embodiment of the stapler of FIG. 1, wherein the handle member has been removed and parts of the magazine and the driver arm are shown broken away to expose further details.

This embodiment of the flat-clinch-stapler comprises a base portion 20 having at a first rear end upstanding bearing pieces 21 (seen in FIG. 2) on both sides of a longitudinal horizontal plane of the stapler for supporting a first transverse pivot axis 22.

The base portion 20 further comprises at a second front end opposite to said first end a floating clincher table 11 for bending the legs of a staple. The floating clincher table 11 is moveable between an upper paper supporting position and a lower staple bending position, and arresting means (not shown) are provided for arresting the floating clincher table 11 in the upper position;

An elongated magazine 5 having an U-shaped cross section comprising a bottom wall 50 and side walls 51 (FIGS. 4 to 8) extending upwardly therefrom comprises staple guide means 52 for receiving and guiding a plurality of staples 53.

The magazine 5 is pivotably mounted at its rear end about said first pivot axis 22 and having a front end extending to a position above said clincher table 11.

A driver arm 1 carrying a driver blade 9 at its front end for driving the most forward staple in said magazine 5 into a paper stack introduced between the base portion 20 and the magazine 5 is pivotably mounted at its rear end to said first pivot axis 22.

A handle member 300 adapted to act against the driver arm 1 is pivotably mounted about a second transverse axis 310 disposed in the bearing pieces 21, said second axis 310 being offset relative to said first pivot axis 22 in a direction from the first end to the second end of the base portion 20.

The handle member 300 is adapted to act on the driver arm 1 at a position even further to the front end of the stapler, thereby resulting in a type of lever action reducing the forces required. to actuate the stapler.

Figure 4:
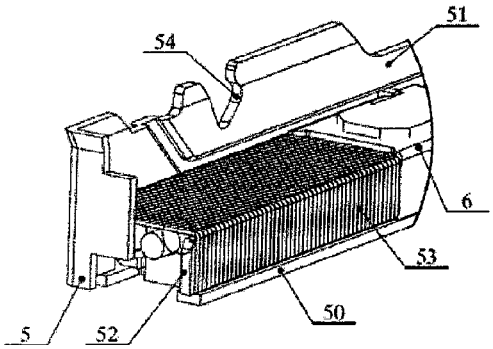
FIGS. 3 to 8 show details of the magazine with parts broken away to show details thereof.
Figure 3:
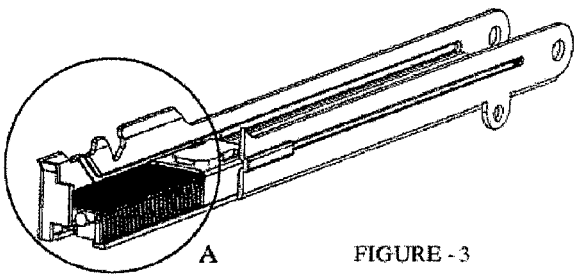
Figure 5:
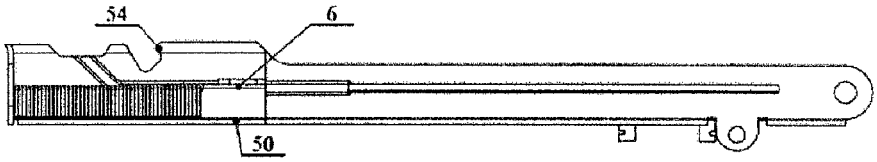
Figure 7:
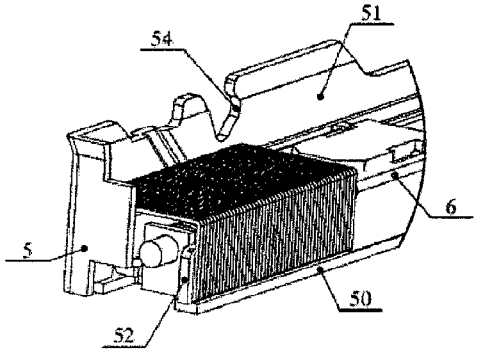
Figure 6:
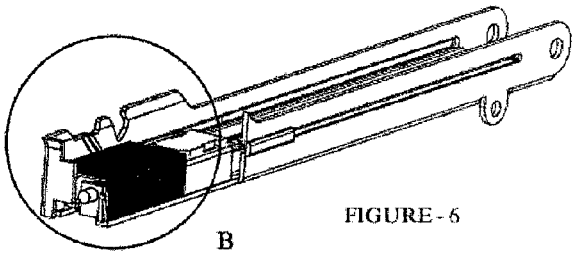
Figure 8:
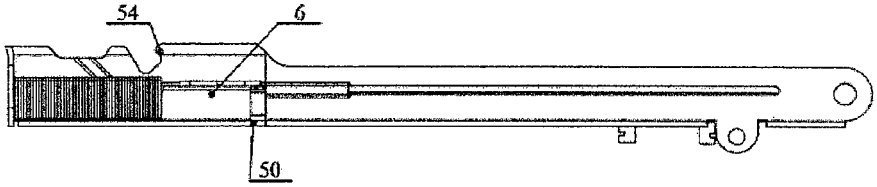

As may especially seen from FIGS. 4 and 7, the bottom wall 50 of the magazine 5 forms part of the guide means for guiding a plurality of staples 53 and is adapted to guide the free ends of the legs of the staples within the magazine 5.

An elongated intermediate member 3 (FIG. 1) is disposed between the magazine 5 and the driver arm 1 and is pivotably mounted at a first end to the first pivot axis 22 within the driver arm 1. Resilient biasing means (not shown) are disposed between said driver arm 1 and the intermediate member 3.

The intermediate member 3 has an inverted U-shaped cross section comprising a top wall 30 and side walls 31 extending downwardly therefrom. The side walls 31 of said intermediate member 3 extend inbetween and along said side walls 51 of said magazine 5, such that the bottom edges of said side walls 31 of said intermediate member 3 being adapted to engage the cross members of said staples 53 within said magazine 5, The side walls of the front end of the intermediate member (3) are provided with respective longitudinal slots 33 adapted to receive end portions of a roller 8, said roller 8 having a length such that its free ends extend beyond the outside of the side walls 31 of the intermediate member 3 and into V-shaped slots 54 in the side walls 51 of the magazine 5. The V-shaped slots 54 extend downwardly from the top edges of the side walls 51 of the magazine 5. Biasing means 7 are provided for biasing the roller 8 against one of the side edges of the V-shaped slots 54 such that the roller 8 rides upwardly along said side edges to space the lower edges of the side walls 31 of the intermediate member 3 from the cross members of the staples within the magazine. In this manner, the roller on riding upwardly along said side edges slightly spaces the lower edges of the side walls 31 of the intermediate member 3 from the cross members of the staples within the magazine 5, such that the advancement of the staples within the magazine by means of a pusher 10 shown in FIG. 4 is not impeded by the intermediate member 3.

This is especially shown in FIGS. 9 to 12.

Figure 9:
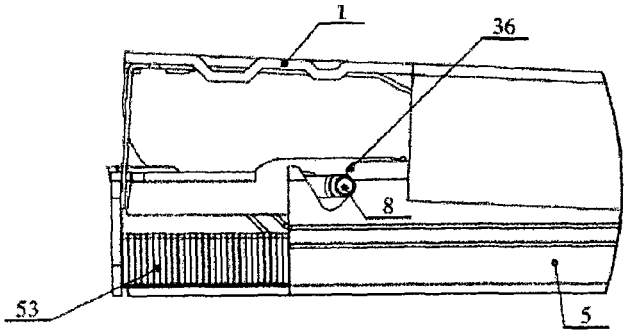
FIGS. 9 to 12 show further details of the front end of the magazine, the intermediate member and the driver arm with staples of different size.
Figure 10:
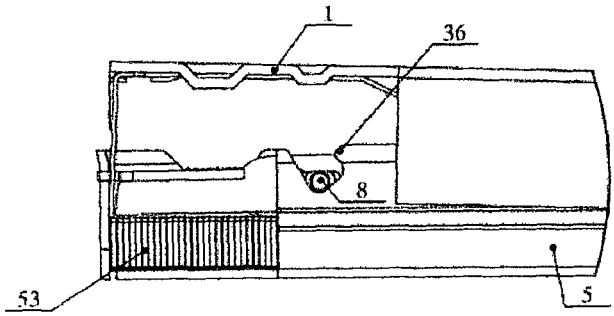

FIG. 9 shows the use of staples having shorter legs. The roller 8 in the rest position abuts against a short projection 36 at the end of one side edge of the V-shaped groove so that the upward movement of the intermediate member 3 relative to the magazine is limited. On pressing down the driver arm 1 by means of the handle member 300 as shown in FIG. 10, the intermediate member 3 is moved downward into engagement with the upper surface of the staples 53 thereby clamping the staples between the bottom wall of the magazine and the intermediate member 3 so that any toppling of the staples is prevented.

Figure 11:
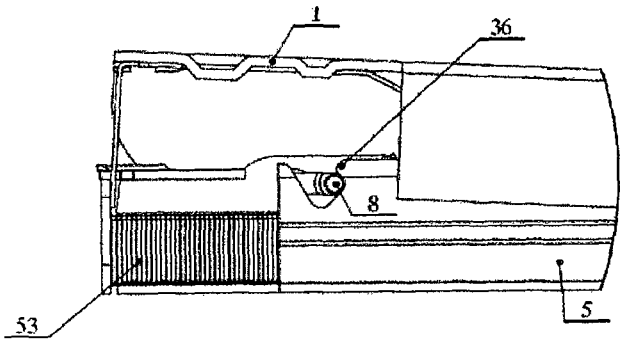
Figure 12:
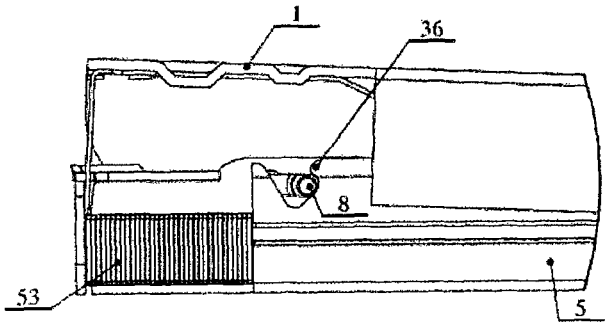

FIG. 11 shows the use of staples having longer legs. The roller 8 in the rest position again abuts against the short projection 36 at the end of one side edge of the V-shaped groove so that the upward movement of the intermediate member 3 relative to the magazine is limited. On pressing down the driver arm 1 by means of the handle member 300 as shown in FIG. 12, the intermediate member 3 is moved downward into engagement with the upper surface of the staples 53 but in view of the greater lengths of the legs of the staples, the roller does move downward over a shorter extent. Again, the staples are clamped between the bottom wall of the magazine and the intermediate member 3 so that any toppling of the staples is prevented.

As may be seen especially from FIGS. 13 to 16, a release lever 2 operative to release the arresting means (not shown) of said floating clincher table 11 is pivotably mounted to said driver arm 1 about a horizontal axis extending perpendicular to a longitudinal axis of said driver arm 1. The release lever 2 comprises downwardly extending release arms 23 acting on the arresting means 110 and a flat cross member 24 connecting said release arms 23 and extending between a bottom surface of said driver arm 1 and a top surface of said intermediate member 3.

Figure 13:
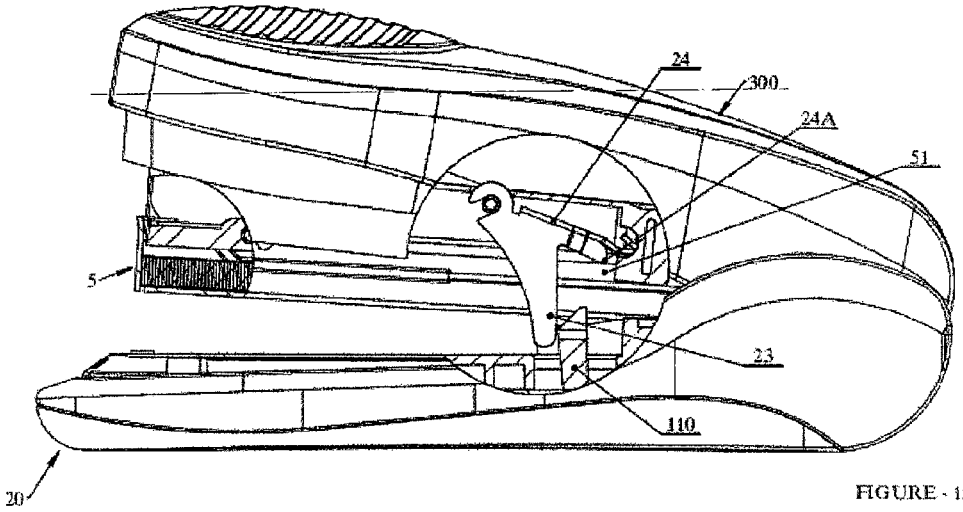
FIGS. 13 to 16 show a side view of the stapler partially broken away for showing the action of the release lever.
Figure 14:
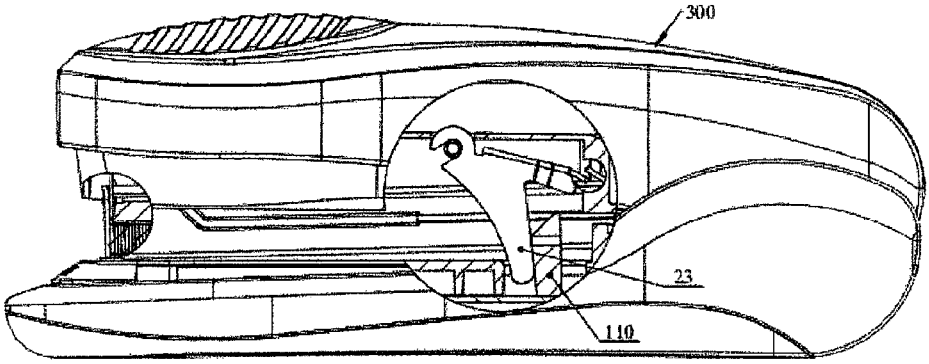

In FIG. 13, the stapler is shown in the rest position, whereas in FIG. 14, the handle member 300 has been depressed to bring the driver blade 9 in contact with the top of the foremost staple in the magazine 5.

Figure 15:
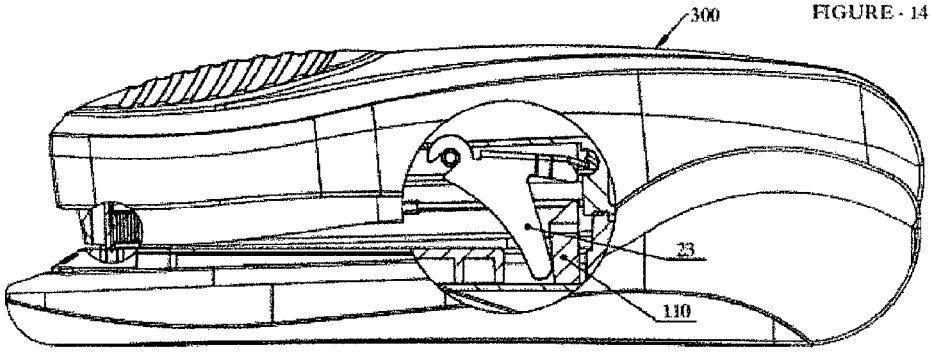

In FIG. 15, the staple has penetrated the stack of paper (not shown) between the bottom of the magazine 5 and the top of the clincher table 11, and the arms 23 of the release lever 2 start the retraction of the arresting means of which only the rear abutment member 110 cooperating with the arms 23 is shown.

Figure 16:
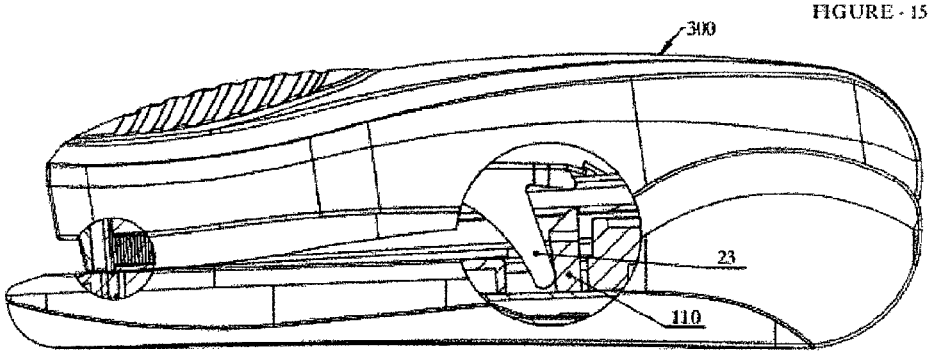

Finally, in FIG. 16, the arms 23 have retracted the arresting means such that the clincher table may move downward thereby resulting in bending the free ends of the legs of the staple inwardly.

Depending on the lengths of the staple legs, the end of cross member 24A of the lever 2 acts while coming in contact with the side walls 51 of the magazine 5 and the arms 23 release the arresting means of the clincher table 11 at an earlier or later time during the downward movement of the driver arm 1.

The invention claimed is:

1. A flat-clinch-stapler comprising:

a base portion having at a first rear end upstanding hearing pieces on both sides of a longitudinal horizontal plane of the stapler for supporting a first transverse pivot axis, and a floating clincher table for bending the legs of a staple at a second front end opposite to said first end, said clincher table being moveable between an upper paper supporting position and a lower staple bending position, and arresting means for arresting the floating clincher table in the upper position;

an elongated magazine having an U-shaped cross section comprising a bottom wall and side walls extending upwardly therefrom, said magazine comprising staple guide means for receiving and guiding a plurality of staples, said magazine being pivotably mounted at its rear end about said first pivot axis and having a front end extending to a position above said clincher table;

a driver arm carrying a driver blade at its front end for driving the most forward staple in said magazine into a paper stack introduced between the base portion and the magazine, said driver arm being pivotably mounted at its rear end to said first pivot axis;

a handle member adapted to act against the driver arm and pivotably mounted about a second transverse axis disposed in the bearing pieces, said second axis being offset relative to said first pivot axis in a direction from the first end to the second end of the base portion, said handle member being adapted to act on the driver arm at a position even further to the front end of the stapler;

said bottom wall of said magazine forming part of the guide means for guiding a plurality of staples and is adapted to guide the free ends of the legs of the staples within the magazine;

an elongated intermediate member being disposed between said magazine and said driver arm and being pivotably mounted at a first end to said first pivot axis within the driver arm, resilient biasing means being disposed between said driver arm and said intermediate member;

said intermediate member having an inverted U-shaped cross section comprising a top wall and side walls extending downwardly therefrom, said walls of said intermediate member extending in between and along said side walls of said magazine, the bottom edges of said side walls of said intermediate member being adapted to engage the cross member of said staples within said magazine;

a release lever operative to release the arresting means of said floating clincher table is being pivotably mounted to said driver arm about a horizontal axis extending perpendicular to a longitudinal axis of said driver arm, said release lever having downwardly extending release arms acting on said arresting means and a flat cross member connecting said release arms and extending between a bottom surface of said driver arm and a top surface of said intermediate member;

said cross member comprising downwardly directed extensions cooperating with the side walls of the magazine;

wherein the side walls of the front end of the intermediate member are provided with respective longitudinal slots adapted to receive end portions of a roller, said roller having a length such that its free ends extend beyond the outside of the side walls of the intermediate member and into V-shaped slots in the side walls of the magazine, said V-shaped slots extending downwardly from the top edges of the side walls of the magazine, biasing means being provided for biasing the roller against one of the side edges of the V-shaped slots such that the roller rides upwardly along said side edges to space the lower edges of the side walls of the intermediate member from the cross members of the staples within the magazine.

2. The flat clinch stapler of claim 1, wherein depending on the lengths of the staple legs, the downwardly extensions of cross member of the lever act while coming in contact with the upper edges of the side walls of the magazine and the arms release the arresting means of the clincher table at an earlier or later time during the downward movement of the driver arm.

* * * * *